US006594452B2

(12) United States Patent
Clark

(10) Patent No.: US 6,594,452 B2
(45) Date of Patent: Jul. 15, 2003

(54) APPARATUS AND METHOD FOR AUTOMATICALLY CHANGING PRINTER MODES

(75) Inventor: Kevin L. Clark, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/037,255

(22) Filed: Oct. 23, 2001

(65) Prior Publication Data

US 2003/0077087 A1 Apr. 24, 2003

(51) Int. Cl.[7] ..... G03G 15/00; G03G 15/20

(52) U.S. Cl. ..... 399/45; 399/16; 399/67; 399/82

(58) Field of Search ..... 399/45, 67, 82, 399/85, 21, 16, 124; 347/5

(56) References Cited

U.S. PATENT DOCUMENTS 4,719,489 A * 1/1988 Ohkubo et al. ..... 399/45
4,753,543 A * 6/1988 Mochimaru et al. ..... 400/703
4,958,195 A * 9/1990 Firth et al. ..... 399/67 X
5,268,726 A * 12/1993 Oleksa et al. ..... 399/322
6,072,585 A * 6/2000 Dutton et al. ..... 358/1.12
6,253,046 B1 * 6/2001 Horrall et al. ..... 399/124
6,327,444 B1 * 12/2001 Hachisuga ..... 399/45
6,381,423 B1 * 4/2002 Eom ..... 399/45

FOREIGN PATENT DOCUMENTS

| | | | |
|---|---|---|---|
| JP | 59-084275 | * | 5/1984 |
| JP | 63-063077 | * | 3/1988 |
| JP | 02-130574 | * | 5/1990 |
| JP | 05-072931 | * | 3/1993 |
| JP | 05-119664 | * | 5/1993 |
| JP | 10-240062 | * | 9/1998 |

* cited by examiner

*Primary Examiner*—Sophia S. Chen

(57) ABSTRACT

An apparatus automatically changing printer modes includes a printer with at least two modes. A fusing assembly is connected to the printer and an automatic fusing assembly manipulator is connected to the printer and to the fusing assembly. In another aspect of the invention, the automatic fusing assembly manipulator is a solenoid device, the printer is a LaserJet printer, the printer connection is a DC controller, and the fusing assembly connection is a cam device. In a further aspect of the invention a default position and a paper jam position are provided.

13 Claims, 1 Drawing Sheet

APPARATUS AND METHOD FOR AUTOMATICALLY CHANGING PRINTER MODES

FIELD OF THE INVENTION

This invention relates to an apparatus and method for automatically changing printer modes. In particular, the invention relates to an apparatus and method for automatically changing printer modes in printers with at least two modes, a media mode and an envelope mode.

BACKGROUND OF THE INVENTION

Today's required office equipment includes at least one printer. And, despite the fact that many messages and data are transferred electronically, demands on office printers continue to increase. As a result, today's office printer is a sophisticated multi-functional device. Nonetheless, old habits and structures die hard.

Today's printers include a printer with a fusing assembly. The fusing assembly is the part which is responsible for correctly positioning media to be printed and fusing the print on the media correctly. Currently, if a user wishes to print both standard media and envelopes on a printer, such as a mail merge job, they must switch fuser levers, connected to the fuser, by hand. They print the media, then switch these fuser levers back to envelope mode to print the envelopes. The user then must manually switch the fuser levers back to media mode to print standard media and so on, back and forth.

If the fuser is not manually switched to envelope mode when envelopes are printed, the print is not properly fused and envelopes often wrinkle, which is offensive to most users. Since many customers will not (or cannot) switch in and out of envelope mode when printing mail-merge jobs, they must make the decision either to live with poor fusing on standard media (leaving the manual levers in the envelope position) or live with wrinkled envelopes (leaving the manual levers in the standard media mode).

A simple software "solution" is not possible. All the software can do is to advise the user to not load envelopes until prompted. At this point, the user could switch the manual fuser levers just as easily and then load the envelope. Additionally, the software solution still will not stop the printer after the envelope is printed if another job is sent.

In short, modern printers are analogous to a modern car that uses handheld lanterns for lighting, an incongruous combination of new and old. As a result, there is a need for providing an apparatus and method for automatically changing printer modes for modern printers.

SUMMARY OF THE INVENTION

Accordingly, the apparatus for automatically changing printer modes of the present invention includes a printer with at least two modes. A fusing assembly is connected to the printer and an automatic fusing assembly manipulator is connected to the printer and to the fusing assembly. In one aspect of the invention, the at least two modes includes a media mode and an envelope mode. In another aspect of the invention, the automatic fusing assembly manipulator is a solenoid device. In a further aspect of the invention, the printer is a LaserJet printer. In still another aspect of the invention, the printer connection is a DC controller. In another aspect of the invention, the fusing assembly connection is a cam device.

In a further aspect of the invention, the automatic fusing assembly manipulator further includes a default position to one of the at least two modes. In another aspect of the invention, the default position is to the media mode. In a further aspect of the invention, the automatic fusing assembly manipulator further includes a paper jam position. And, in another aspect of the invention, the paper jam position is to the envelope mode.

In a further embodiment of the invention, in a printer with at least a media mode and an envelope mode, an apparatus for automatically changing modes includes the fusing assembly connected to the printer and a solenoid device for automatically changing the modes connected to a DC controller on the printer and to a cam device on the fusing assembly. In another aspect of the invention, the solenoid device includes a default position to one of the two modes, media and/or envelope. In another aspect of the invention, the default mode is to the media mode. In yet another aspect of the invention, the solenoid device further includes a paper jam position and, in another aspect of the invention, the paper jam position is to the envelope mode.

In yet another embodiment of the invention, in a printer with at least a media mode and an envelope mode, a method for automatically changing printer modes comprises the first step of connecting a fusing assembly to the printer. A DC controller is provided on the printer and a solenoid device, for automatically changing modes, is connected to the DC controller. A cam device is attached to the fusing assembly and the solenoid device is also connected to the cam device. A print job is directed to the printer including media and envelope(s). The DC controller detects which mode is to be printed and sends an appropriate signal to the solenoid device. Finally, upon receipt of the DC controller signal, the solenoid device activates the cam device as directed.

In a further aspect of the method of the invention, a default position is provided for the solenoid device to default to one of the media mode and/or the envelope mode. In another aspect of the method, the default mode is to the media mode. In a further aspect of the method, the step of providing a paper jam position for the solenoid device is added. Finally, in another aspect of the method, the paper jam position is to the envelope mode.

DETAILED DESCRIPTION OF THE INVENTION

Figure 1:
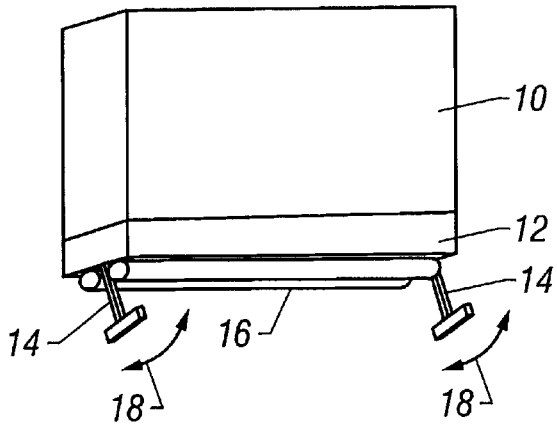
FIG. 1 (Prior Art)
FIG. 1 is a perspective view of a Prior Art printer with manual levers used for changing printer modes by hand.
Figure 2:
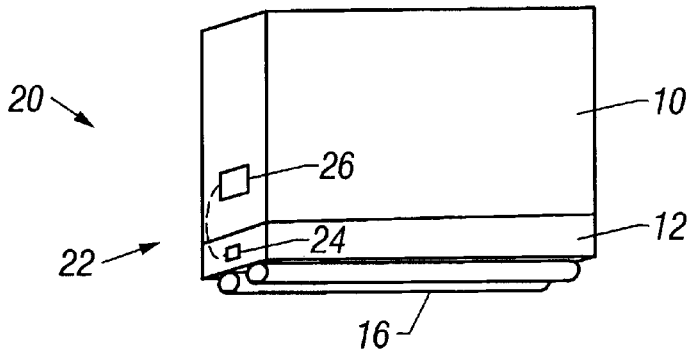
FIG. 2 is a perspective view of the apparatus for automatically changing printer modes of the present invention shown in the media mode.
Figure 3:
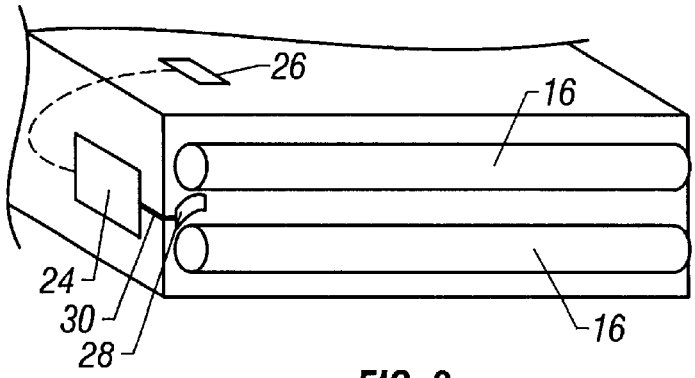
FIG. 3 is a close up perspective view of the invention as shown in FIG. 2 in the envelope mode and illustrating the cam device of the present invention.

The preferred embodiment of the present invention is illustrated by way of example in FIGS. 2 and 3. With specific reference to FIG. 1, the state of the Prior Art is illustrated. As previously mentioned, present-day printers 10 include fusing assembly 12 with manual levers 14. Manual levers 14 are connected to pinch rollers 16. As illustrated in FIG. 1, pinch rollers 16 are shown in the standard/media position with pinch rollers 16 closed. According to the Prior Art, in order to change media positions, it is necessary for the user to physically grasp manual levers 14 and move them in the direction of direction arrows 18. This tedious procedure is repeated again and again as the media changes in a particular print job. It is no wonder, therefore, that users of modern printers typically would rather suffer one downside of a standard choice they make or the other and do not move the fuser assembly 12 during a particular print job.

Referring now to FIG. 2, the apparatus for automatically changing printer modes 20 is illustrated. In the preferred embodiment, printer 10 includes at least two modes. The printer 10 may be any printer now known or hereafter developed including particularly, for example, LaserJet printers. Specifically, for further example, Hewlett-Packard's LJ5si, LJ 8000 and LJ 8100 printers are typical of the types of printers with which the present invention is useful. The typical two modes found in modern printers are the media or standard mode and the envelope mode. Certainly, any additional or other modes now known or hereafter developed are encompassed within the scope of the present invention.

Additionally, in a preferred embodiment, apparatus for automatically changing printer modes 20 of the present invention includes a fusing assembly 12. The fusing assembly 12, again, is any fusing assembly now known or hereafter developed designed to accommodate the at least two modes. In a preferred embodiment, an automatic fusing assembly manipulator 22 is connected to printer 10 and to fusing assembly 12. In a further preferred embodiment, automatic fusing assembly manipulator 22 is a solenoid 24. Further, in a preferred embodiment, automatic fusing assembly manipulator 22 is connected to printer 10 by means of a DC controller 26 and to the fusing assembly 12 by means of cam 28.

Referring now to FIG. 3, a closer to view of the apparatus for automatically changing printer modes 20 is illustrated. In FIG. 3, automatic fusing assembly manipulator 22, in the form of solenoid 24, has received a signal from DC controller 26 to activate and to open pinch rollers 16. As a result, solenoid 24 activates cam 28 to place pinch rollers 16 in the open position. While this could be any particular position for any known type of a particular printer, for purposes of illustration, FIG. 3 illustrates the envelope mode of the present invention. The closed position of pinch rollers 16 represents the media mode.

By way of illustration, and not limitation, solenoid 24 may be any type of solenoid now known or hereafter developed or any other electro-mechanical device suitable for accomplishing the objectives of the present invention. Likewise, DC controller 26 is any known or hereafter developed controlling device designed to provide low-cost high-performance adjustable power supply and signals for PCs and the like. By way of further illustration, DC controller 26 functions in much the same way as known in the Prior Art whereby printer engines are switched into transparency mode when a transparency is printed. That is to say, DC controller 26 receives input from the printer 10 about a print job. As the print job begins, DC controller 26 signals solenoid 24 to assume the proper position for the job, media or envelope. As the job progresses, DC controller simply signals solenoid 24 to change position as needed, automatically and easily and with no need for user involvement.

By way of example, referring to FIGS. 2 and 3, as a print job begins, DC controller 26 determines that printer rollers 16 are closed and in position to receive media mode material. As a print job starts, media mode material is allowed to be processed without change of print rollers 16. As the print job proceeds, however, and envelopes are required to be printed, DC controller 26 signals solenoid 24 to open print rollers 16. This is done simply by an electrical signal sent to solenoid 24 which activates solenoid 24 moving solenoid arm 30 attached to cam 28 which presses pinch rollers 16 into the open position illustrated in FIG. 3. Thereafter, when the print job requires media to be printed, DC controller 26 signals solenoid 24 and solenoid arm 30 is retracted hereby closing pinch rollers 16.

In a preferred embodiment, the apparatus for automatically changing printer modes 20 of the present invention further includes a default position. In a further aspect of this embodiment, the default position is to the media mode/the closed mode illustrated in FIG. 2. That is to say, once an envelope job is completed, solenoid 24 automatically returns to the default position, media mode.

Likewise, in a preferred embodiment, a paper jam position is automatically provided. In this aspect of the invention, when DC controller 26 detects a paper jam, solenoid 24 is engaged such that pinch rollers 16 are forced to the open position illustrated in FIG. 3. This makes it much easier for users to remove media jammed in the fuser 12.

As discussed above, in another preferred embodiment, a method for automatically changing modes is also provided. In operation, a user of the apparatus for automatically changing printer modes 20 of the present invention connects a fusing assembly 12 to a printer 10 as is known in the art. DC controller 26 is connected to printer 10 and also to solenoid 24. The solenoid 24 is connected to cam 28 and cam 28 is connected to fusing assembly 12 so as to operate pinch rollers 16. A print job is directed to printer 10, the print job including media and envelope(s). Thereafter, controller 26 detects which mode is to be printed and sends an appropriate signal to solenoid 24. Upon receipt of the signal, solenoid 24 activates cam 28, as discussed above. Preferably, a default mode is provided such that apparatus for automatically changing printer modes 20 defaults to the media mode. Additionally, preferably, a paper jam position is provided such that the paper jam position is to the envelope mode.

The description of the present embodiments of the invention have been presented for purposes of illustration but are not intended to be exhaustive or to limit the invention to the form disclosed. Many modifications and variations will be apparent to those of ordinary skill in the art. As such, while the present invention has been disclosed in connection with the preferred embodiment thereof, it should be understood that there may be other embodiments would fall within the spirit and scope of the invention as defined by the following claims.

What is claimed is:

1. An apparatus for changing printer modes, the apparatus comprising:

a) a printer with at least two modes;

b) a fusing assembly connected to said printer;

c) an automatic fusing assembly manipulator connected to said printer and to said fusing assembly wherein said automatic fusing assembly manipulator includes a paper jam position; and d) wherein said at least two modes includes a media mode and an envelope mode and wherein said paper jam position is to said envelope mode.

2. The apparatus of claim 1 wherein said automatic fusing assembly manipulator is a solenoid device.

3. The apparatus of claim 1 wherein said printer is a laser jet printer.

4. The apparatus of claim 1 wherein said printer connection is a DC controller.

5. The apparatus of claim 1 wherein said fusing assembly connection is a cam device.

6. The apparatus of claim 1 wherein said automatic fusing assembly manipulator further comprises a default position to one of said at least two modes.

7. The apparatus of claim 6 wherein said at least two modes includes a media mode and an envelope mode and wherein said default position is to said media mode.

8. In a printer with at least a media mode and an envelope mode, an apparatus for automatically changing modes, the apparatus comprising:

a) a fusing assembly connected to said printer; and b) a solenoid device for automatically changing said modes connected to a DC controller on said printer and to a cam device on said fusing assembly;

c) wherein said solenoid device includes a paper jam position and wherein said paper jam position is to said envelope mode.

9. The apparatus of claim 8 wherein said solenoid device further comprises a default position to one of said media mode and said envelope mode.

10. The apparatus of claim 9 wherein said default mode is to said media mode.

11. In a printer with at least a media mode and an envelope mode, a method for automatically changing modes, the method comprising the steps of:

a) connecting a fusing assembly to said printer;

b) providing a DC controller on said printer;

c) connecting a solenoid device for automatically changing modes to said DC controller;

d) attaching a cam device to said fusing assembly;

e) connecting said solenoid device to said cam device;

f) directing a print job to said printer including media and envelope(s);

g) said DC controller detecting which mode is to be printed and sending an appropriate signal to said solenoid device;

h) providing a paper jam position for said solenoid device wherein said paper jam position is to said envelope mode; and i) upon receipt of the DC controller signal, said solenoid device activating said cam device as directed.

12. The method of claim 11 further comprising the step of providing a default position for said solenoid device to one of said media mode and said envelope mode.

13. The method of claim 12 wherein said default mode is to said media mode.

* * * * *